US008881409B2

(12) United States Patent
Haman

(10) Patent No.: US 8,881,409 B2
(45) Date of Patent: Nov. 11, 2014

(54) ARTICULATING OSCILLATING POWER TOOL

(75) Inventor: Brian Haman, Cary, IL (US)

(73) Assignee: Robert Bosch GmbH, Stuttgart (DE)

( * ) Notice: Subject to any disclaimer, the term of this patent is extended or adjusted under 35 U.S.C. 154(b) by 260 days.

(21) Appl. No.: 13/350,954

(22) Filed: Jan. 16, 2012

(65) Prior Publication Data

US 2013/0181414 A1 Jul. 18, 2013

(51) Int. Cl.
*B25F 5/00* (2006.01)

(52) U.S. Cl.
USPC ..... 30/392; 173/49; 173/217; 279/141; 451/357

(58) Field of Classification Search
USPC ..... 30/272.1, 392–394, 277.4, 371, 276; 483/34; 83/478; 408/131; 279/141; 81/57.26; 451/121, 356–358; 310/250; 173/29, 38, 49, 90, 213, 216, 217
See application file for complete search history.

(56) References Cited

U.S. PATENT DOCUMENTS

| | | | | |
|---|---|---|---|---|
| 4,543,720 | A | 10/1985 | Grunikiewicz et al. | |
| 5,000,684 | A * | 3/1991 | Odrich | 433/125 |
| 7,108,077 | B2 * | 9/2006 | Zaiser | 173/48 |
| 7,204,026 | B2 * | 4/2007 | Phillips et al. | 30/394 |
| 7,207,233 | B2 | 4/2007 | Wadge | |
| 7,584,542 | B2 * | 9/2009 | Smith | 30/276 |
| 7,926,585 | B2 | 4/2011 | Pozgay et al. | |
| 8,182,316 | B2 * | 5/2012 | Peisert | 451/356 |
| 2002/0193055 | A1 * | 12/2002 | Tiede et al. | 451/344 |
| 2003/0110645 | A1 * | 6/2003 | Phillips et al. | 30/392 |
| 2003/0220058 | A1 * | 11/2003 | Pollak et al. | 451/357 |
| 2005/0262708 | A1 * | 12/2005 | Haas et al. | 30/392 |
| 2007/0094877 | A1 * | 5/2007 | Bohne et al. | 30/392 |
| 2009/0100690 | A1 * | 4/2009 | Delfini et al. | 30/392 |
| 2009/0197514 | A1 * | 8/2009 | Peisert | 451/356 |
| 2009/0217531 | A1 * | 9/2009 | Muraguchi | 30/45 |
| 2010/0064524 | A1 * | 3/2010 | Mah et al. | 30/123.5 |
| 2011/0209888 | A1 * | 9/2011 | Elsworthy | 173/217 |
| 2012/0192438 | A1 * | 8/2012 | Aoki et al. | 30/392 |

* cited by examiner

*Primary Examiner* — Boyer D Ashley
*Assistant Examiner* — Fernando Ayala
(74) *Attorney, Agent, or Firm* — Maginot Moore & Beck LLP

(57) ABSTRACT

An oscillating power tool includes a tool head which can be articulated through a range of positions including zero to ninety degrees. The tool head can accept a variety of accessory tools which move in a reversing angular displacement as well as articulate throughout the range of positions.

23 Claims, 8 Drawing Sheets

ARTICULATING OSCILLATING POWER TOOL

FIELD

This invention relates to the field of power tools, and more particularly to a handheld power tool having an oscillating tool which can be articulated through a range of positions including zero to ninety degrees.

BACKGROUND

Oscillating power tools are lightweight, handheld tools configured to oscillate various accessory tools and attachments, such as cutting blades, sanding discs, grinding tools, and many others. The accessory tools and attachments can enable the oscillating power tool to shape and contour workpieces in a many different ways. Previously known oscillating tools, however, are limited in their ability to perform certain tasks in work areas that are difficult to access. These oscillating power tools have fixed tool heads which can limit the number of tasks that can be performed. Oscillating power tools with fixed tool heads can also cause the user to locate the tool in less convenient positions when performing work. Sometimes the position of the power tool necessitated by the nature of the workpiece can be inadequate to effectively complete a task. The user may be forced to either select another tool to complete the task, or resort to non-powered tools, both of which can increase the amount of time to complete a task as well as reduce the amount of time the user can work on the workpiece due to fatigue.

For example, while different types of accessory tools are available to perform cutting, scraping, and sanding operations, the use of such accessory tools is limited in an oscillating power tool where the tool head is fixed with respect to the tool, the tool body or tool handle. The range of uses for these accessory tools, consequently, can be rather narrow, since the output orientation of the oscillating tool head is fixed according to the position of the power tool, the tool body or tool handle. For example, a flush cutting blade accessory for an oscillating power tool can be used to trim or shave thin layers of material from the surface of a workpiece. Because this type of accessory can present a risk that the blade can gouge the surface and possibly ruin the workpiece, orientation of the tool head is important and made more difficult in power tools with fixed tool heads. What is needed, therefore, is a handheld articulating oscillating power tool that provides access to areas that are otherwise inaccessible or difficult to access.

SUMMARY

In accordance with one embodiment of the present disclosure, there is provided an articulating power tool including a housing and a motor located in the housing. The motor includes a drive shaft configured for rotation about a first axis. An actuator is operatively coupled to the drive shaft configured to convert the rotation of the drive shaft to a reversing angular displacement. A tool holder is coupled to the actuator and configured to move in response to movement of the actuator. An articulator is operatively coupled to the housing and to the tool holder, wherein the articulator is configured to adjust the tool holder through a range of positions.

In another embodiment, an articulating handheld power tool includes a housing and a motor having a drive shaft with an eccentric configured to rotate about a first axis. A fork includes a first branch having a first end, a second branch having a second end, and a central portion coupled to the first branch and the second branch, wherein at least one of the first end and second end intermittently contact the eccentric to move the central portion in a reversing angular displacement. A tool holder is coupled to the central portion of the fork and is configured to move in response to the movement of the central portion. An articulating arm operatively coupled to the housing and to the tool holder is configured to move the tool holder through a range of positions.

DESCRIPTION

Figure 1:
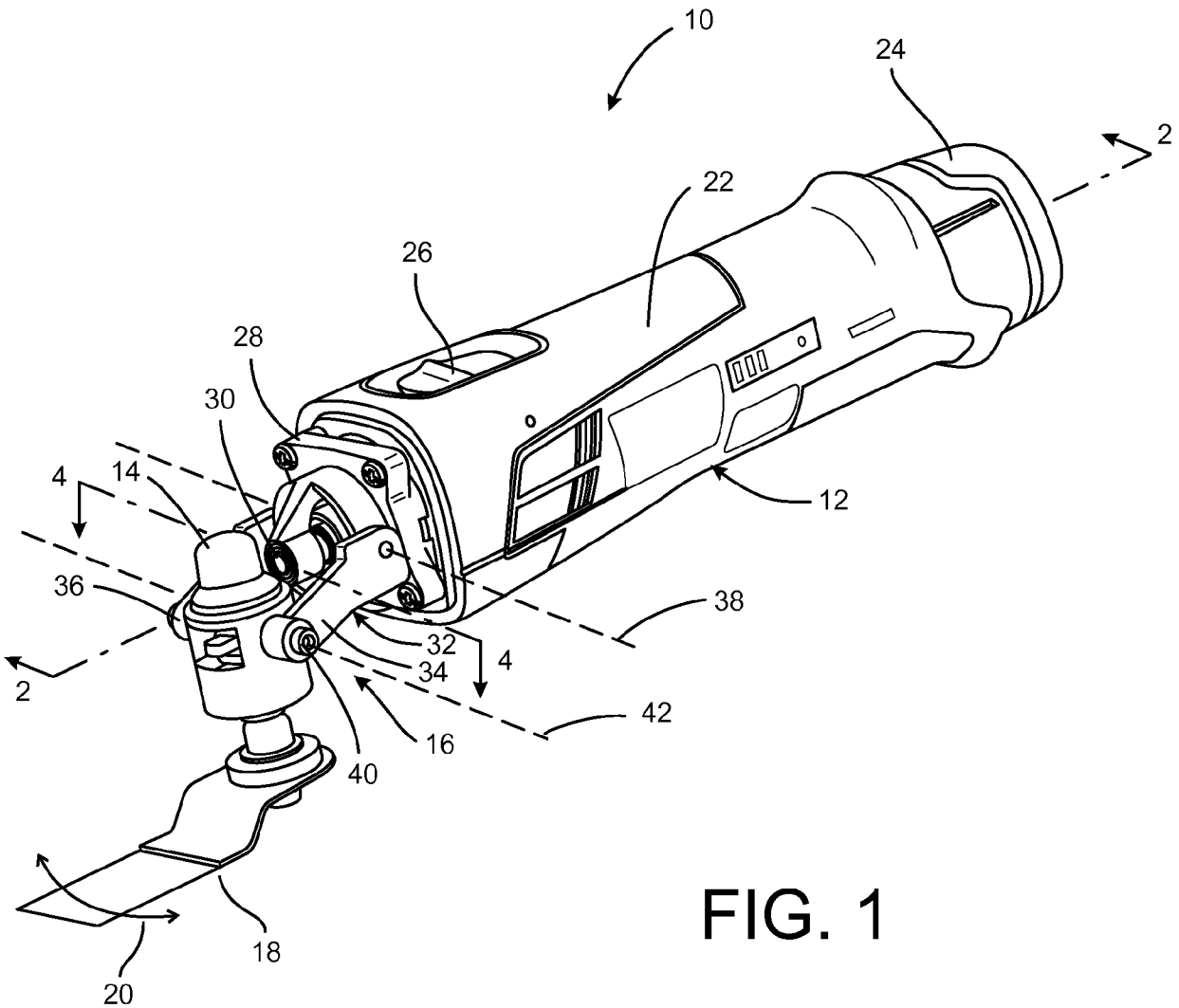
FIG. 1 is a perspective view of an oscillating power tool including an articulating tool holder.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

FIG. 1 illustrates an oscillating power tool 10 having a generally cylindrically shaped housing 12 having a tool holder 14, or tool head, located at a front end 16 of the tool 10. The tool holder 14 is adapted to accept a number of different tools or tool accessories, one of which is illustrated as a scraping tool 18. The scraping tool 18 oscillates from side to side or in a reversing angular displacement along the direction 20. Other oscillating accessory tools are known and include those having different sizes, types, and functions including those performing cutting, scraping, and sanding operations. The housing 12 can be constructed of a rigid material such as plastic, metal, or composite materials such as a fiber reinforced polymer. The housing 12 can include a nose housing (not shown) to cover the front of the tool, the tool head, and related mechanisms.

The housing 12 includes a handle portion 22 which can be formed to provide a gripping area for a user. A rear portion 24 of the housing can include a battery cover which opens and closes to accept replaceable or rechargeable batteries. The cover can also be part of a replaceable rechargeable battery so that the cover stays attached to the rechargeable battery as part of a battery housing. Housing 12 includes a power switch 26 to apply power to or to remove power from a motor (to be described later) to move the tool 18 in the oscillating direction 20. The power switch 26 can adjust the amount of power provided to the motor to control motor speed and the oscillating speed of the tool 18. In one embodiment, the motor comprises an electric motor configured to receive power from a battery or fuel cell. In other embodiments, electric power to the motor may be received from an AC outlet via a power cord (not shown). As an alternative to electric power, the oscillating power tool 10 may be pneumatically driven, fuel powered, such as gas or diesel, or hydraulically powered.

The front end 16 of the tool 10 includes a drive shaft support 28 which receives a drive shaft coupled to the motor, an end portion 30 of which is supported for rotation within the support 28. An articulator 32 includes an articulating support having a first articulation arm 34 and a second articulation arm 36, each having a first end pivotally coupled to the drive shaft support 28 at an axis of rotation 38. A second end of the arms 34 and 36 are coupled to the tool holder 14 by respective bolts 40. Each of the bolts 40 can fix the arms 34 and 36 to the tool holder 14 such that rotation of the tool holder 14 does not occur at the location of the bolts 40. The interface between the arms 34 and 36 and the tool holder can, however, be configured to allow rotational movement of the tool holder around an axis 42 to provide an additional location of tool head adjustment.

Figure 2:
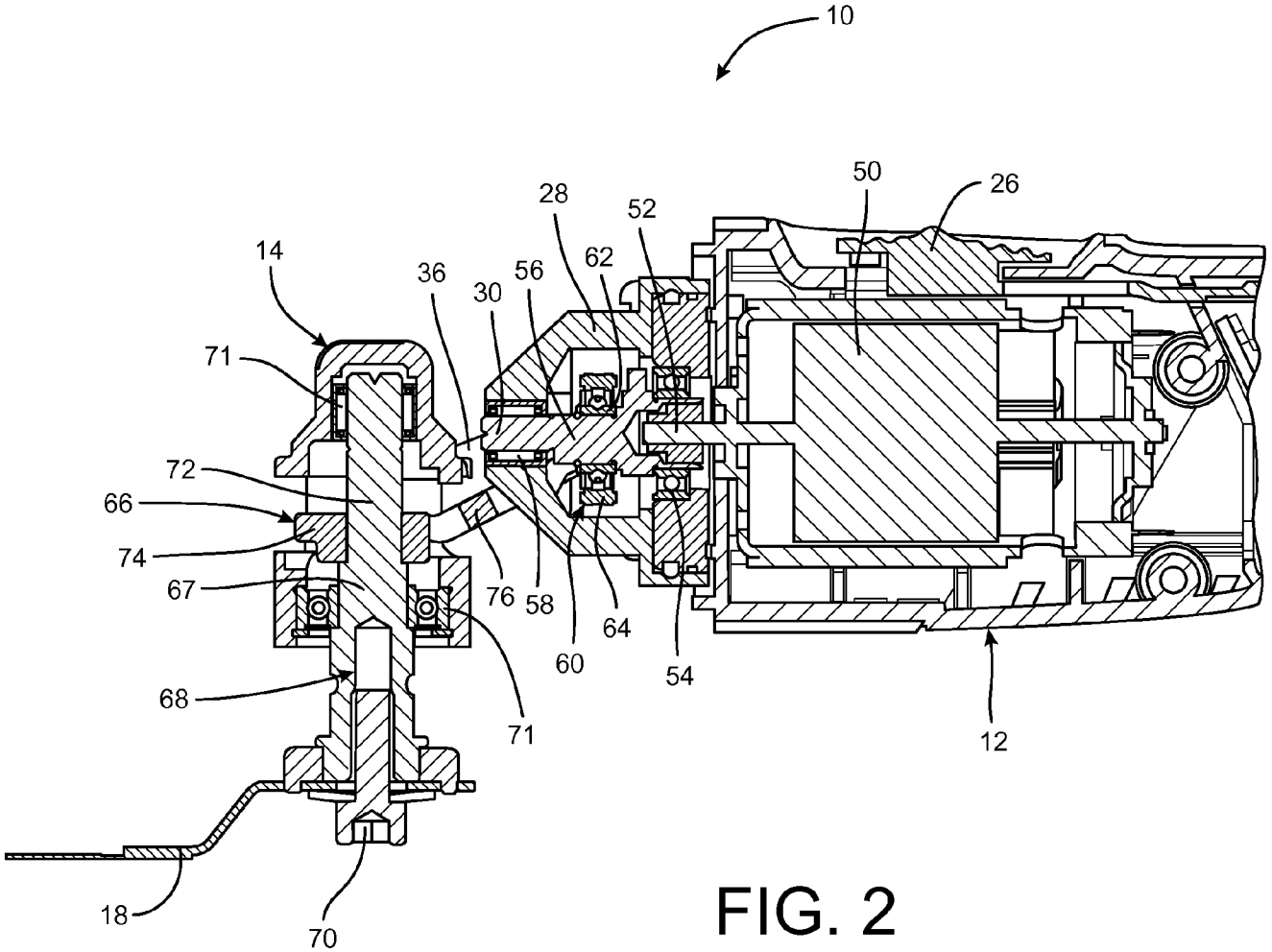
FIG. 2 is a sectional elevational side view of the tool of FIG. 1 taken along a line 2-2 and viewed in the direction of the arrow.

FIG. 2 is a sectional elevational side view of a portion of the tool of FIG. 1 taken along a line 2-2 and viewed in the direction of the arrows. The tool 10 supports a motor 50 including a drive shaft 52 within the housing 12. The shaft 52 of the motor 50 is generally aligned along a longitudinal axis of the housing 12 and is supported for rotation within a bearing 54. At the terminating end of the drive shaft 52, an eccentric drive shaft 56 is mounted having the portion 30 of the eccentric drive shaft mounted for rotation within a support housing bearing 58. The eccentric drive shaft 56 includes a central portion to which an eccentric drive bearing 60 is mounted. The eccentric drive bearing includes an inner ring 62 fixedly mounted to the eccentric drive shaft 56 and an outer ring 64 rotatably mounted about the inner ring 62. A plurality of rolling element bearings is located between the inner ring and outer ring to complete the bearing. Ball bearings or cylinder bearings can be used accordingly.

Because the inner ring 62 is fixed to the eccentric drive shaft, the surface of the inner ring follows an eccentric path which in turn causes an outer surface of the outer ring 64 to move along an eccentric path. While the eccentric bearing 60 is not eccentric per se, the placement of the bearing 60 on the eccentric drive shaft 56 provides what is known as an "eccentric" to convert the rotational motion of the drive shaft 52 to a linear motion.

A link 66 is operatively coupled to the outer ring 64 and to a tool mount 67 located within the tool holder 14. The tool mount 67 is generally a cylindrically shaped shaft and extends from a bottom portion of the tool holder 14 and includes a recess 68 adapted to accept the tool 18 in a fixed position with respect to the tool mount 67. Other shapes of the tool mount are possible. The tool 18 can be fixedly mounted to the tool mount 67 by a bolt 70 extending into the tool 18 and the recess 68. The tool holder 14 and/or tool mount 67 can be formed to include a friction fit interface between the tool 18 and the recess 68 to provide a fixed mounting location for the tool without the need for a bolt or other fastener. Bearings 71, operatively coupled to the tool mount 67, provide for rotational movement of the tool mount 67 within the tool holder 14.

A mounting portion 72 of the tool mount 67 is formed to accept an end 74, also called a central portion, of the link 66 such that the end 74 is held in a fixed position with respect to the mount 67. The mounting portion 72 can include a key which mates with a corresponding mating feature formed in the end 74 the link 66.

Figure 3:
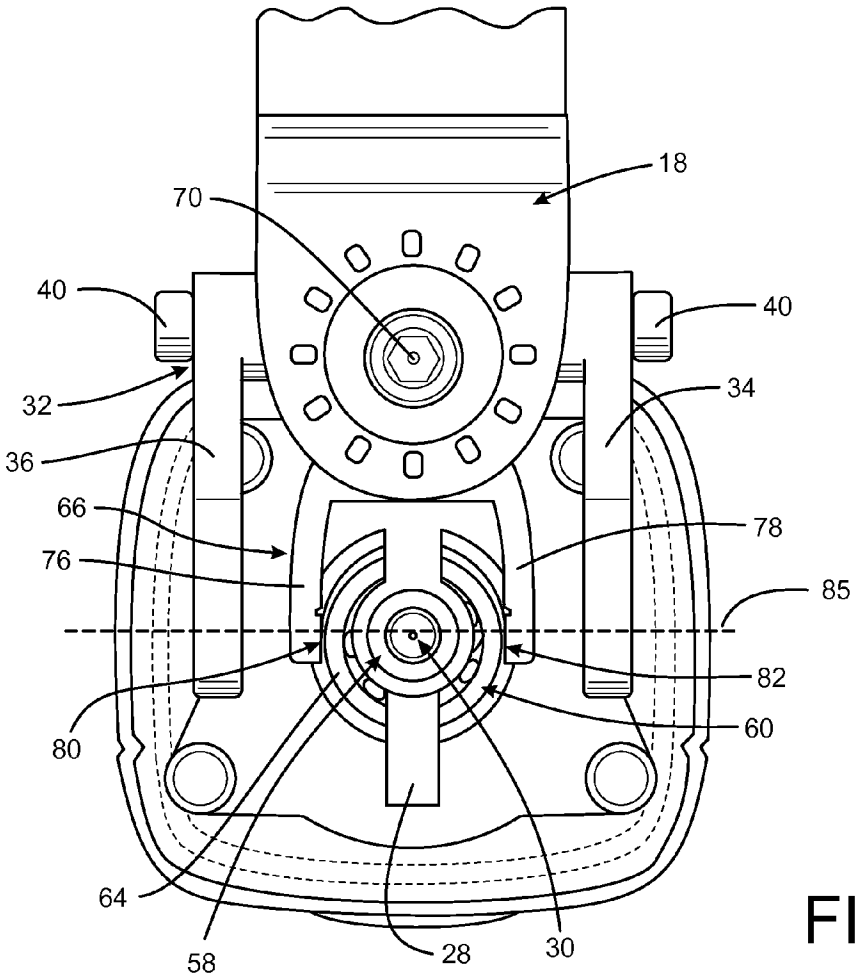
FIG. 3 is a front view of the nose portion of the tool of FIG. 1 with articulating arms located at ninety (90) degrees with respect to a longitudinal axis of the tool.

As further illustrated in FIG. 3, the link 66 is operatively coupled to and actuated by the outer ring 64 to move responsively to the rotation of the drive shaft 52 and the inner ring 62. The end 74 therefore actuates the tool 18 bi-directionally in the direction 20 of FIG. 1. In one embodiment of the present disclosure, the link includes a first branch 76 and a second branch 78 coupled to the connecting end 74. Each of the first branch 76 and second branch 78 include respective terminating ends. The first branch 76 includes, at the terminating end, a contacting surface 80 and the second branch 78 includes, at the terminating end, a contacting surface 82. The terminating ends extend at right angles from the branches, but other configurations are possible. Each of the contacting surfaces 80 and 82 are positioned adjacent to the outer ring 64 and can be spaced from the outer surface of the outer ring 64 depending on the positions of the contacting surfaces 80 and 82 and the outer ring. The link and the central portion maintain the location of the contacting surfaces 80 and 82 at the outer surface of the outer ring 64. By providing a first branch and a second branch having open ends, a fork is formed.

During continuous rotation of the drive shaft 52, the eccentric drive shaft 56 moves the inner ring 62 eccentrically and continuously about the longitudinal axis of the tool 10 which forces the outer surface of outer ring 64 to move eccentrically as well. The outer ring does not typically rotate continuously but moves intermittently. This eccentric motion is transferred to the contacting surfaces 80 and 82, which are each spaced a predetermined distance from the outer surface of the outer ring 64 during at least part of the rotation of the eccentric drive shaft. Intermittent contact occurs between the outer surface of the outer ring and at least one of contacting surfaces 80 and 82 during operation. Consequently, the terminating ends of the first branch 76 and the second branch 78 oscillate generally from side to side along a line 85 due to the eccentric movement of the outer ring 64. In one embodiment, the spacing between a contacting surface 80 or 82 and the outer surface of the outer ring 64 can range from about 0.05 to 0.1 mil. As the inner ring 62 rotates continuously, the outer surface of the outer ring 64 moves generally continuously with the inner ring 62.

In FIG. 3, the line 85 also represents a pivot axis about which the ends of the branches 76 and 78 rotate when the tool head 14 is articulated. In this embodiment, therefore, the axis of rotation 38 and the axis of rotation at the line 85 are co-linear. In other embodiments, the axis of rotation of the articulating arms and the direction of oscillation of the link are not co-linear.

Side to side motion of the outer surface of the outer ring 64 is harnessed by the contacting surfaces 80 and 82 to cause the first branch 76 and the second branch 78 to move generally side to side along the line 85 which in turn moves the tool 18 in repeating and reversing arcs of movement. See FIG. 3. Because the outer surface of the outer ring 64 moves eccentrically, the point of contact at the contacting surfaces 80 and 82 varies at the surfaces and is not fixed exactly at the line 85. The linear motion of each branch, however, while limited to the eccentricity of the outer ring, is sufficient to move the branches and the end 74 which causes the tool mount 67 to turn about the axis thereof in a reversing angular direction. Consequently, the tool mount 67 does not move in complete rotations about an axis. The tool 18 responds accordingly in an oscillating fashion to provide the desired function, including sanding, grinding, cutting, buffing, or scraping.

Figure 6:
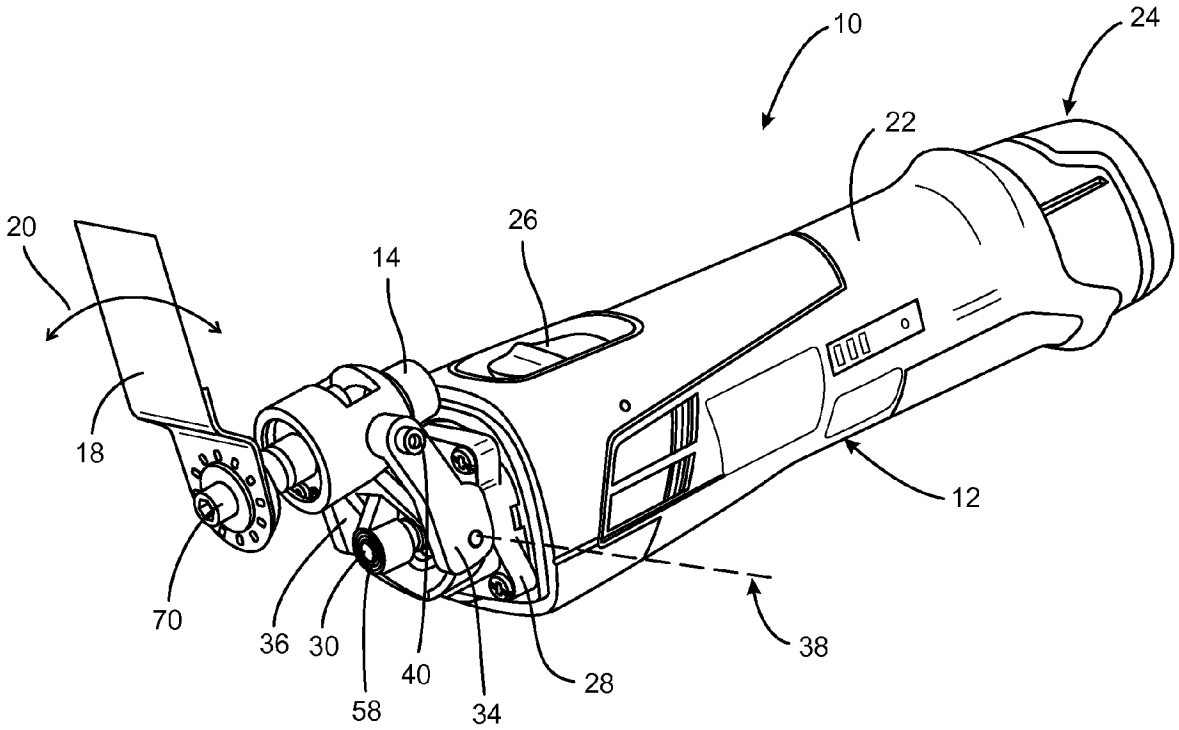
FIG. 6 is a perspective view of the oscillating power tool of FIG. 1 with the articulating arms located at ninety (90) degrees with respect to the longitudinal axis of the tool.

FIG. 6 provides another view of the oscillating power tool of FIG. 3 in perspective with the articulating arms located at approximately ninety (90) degrees with respect to the longitudinal axis of the tool. While articulation is illustrated at zero and ninety degrees, the embodiments are not limited to this range of motion. Articulation at greater than ninety degrees is also possible.

As previously described with respect to FIG. 1, the first articulation arm 34 and the second articulation arm 36 are coupled to the support 28 and move in an arc about the axis 38. In the illustrated embodiment, this axis of rotation 38 coincides in at least one plane with the line 85 as illustrated in FIG. 3. Because the arms 34 and 36 rotate about the axis 38 and the link 66 is coupled to the tool head 14, the contacting surface 80 of the first branch 76 and the contacting surface 82 of the second branch 78 also generally rotate about the axis 38. Consequently, the first branch 76 and second branch 78 are maintained at the predefined pivot axis due to the location of the pivot axis 38, the location of the arms 34 and 36, and the location of the drive bearing 60. Side to side movement of the first branch 76 and second branch 78 therefore generally occurs along the line 85 during positioning of the tool holder 14 throughout the tool holder range of motion.

Figure 4:
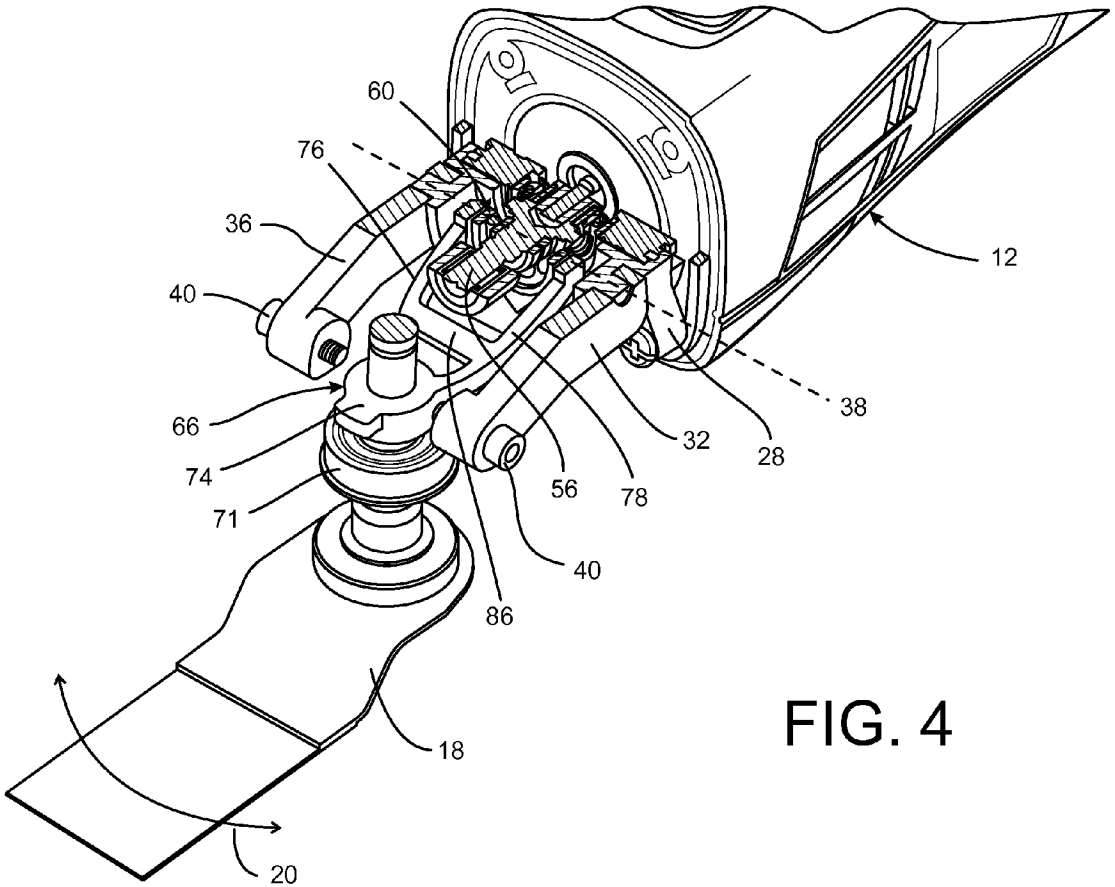
FIG. 4 is a partial sectional perspective view of a portion of the tool of FIG. 1 along a line 4-4 without the housing for the tool holder.

FIG. 4 is a partial sectional perspective view of a portion of the power tool 10 of FIG. 1 along a line 4-4 without the housing for the tool holder 14. In FIG. 4, the housing of the tool holder 14 has been removed to illustrate the connection of the link 66 to the tool mount 67. The bearing 71 is illustrated. Each of the branches 76 and 78, which are coupled to the central portion 74, are coupled by a crosspiece 86 which provides additional rigidity to the link 66. While the crosspiece 86 is not required, the location of the crosspiece 86 between the central portion 74 and the contacting portions 80 and 82 can maintain an adequate clearance between the outer surface of the outer ring 64 and the portions 80 and 82.

Figure 5:
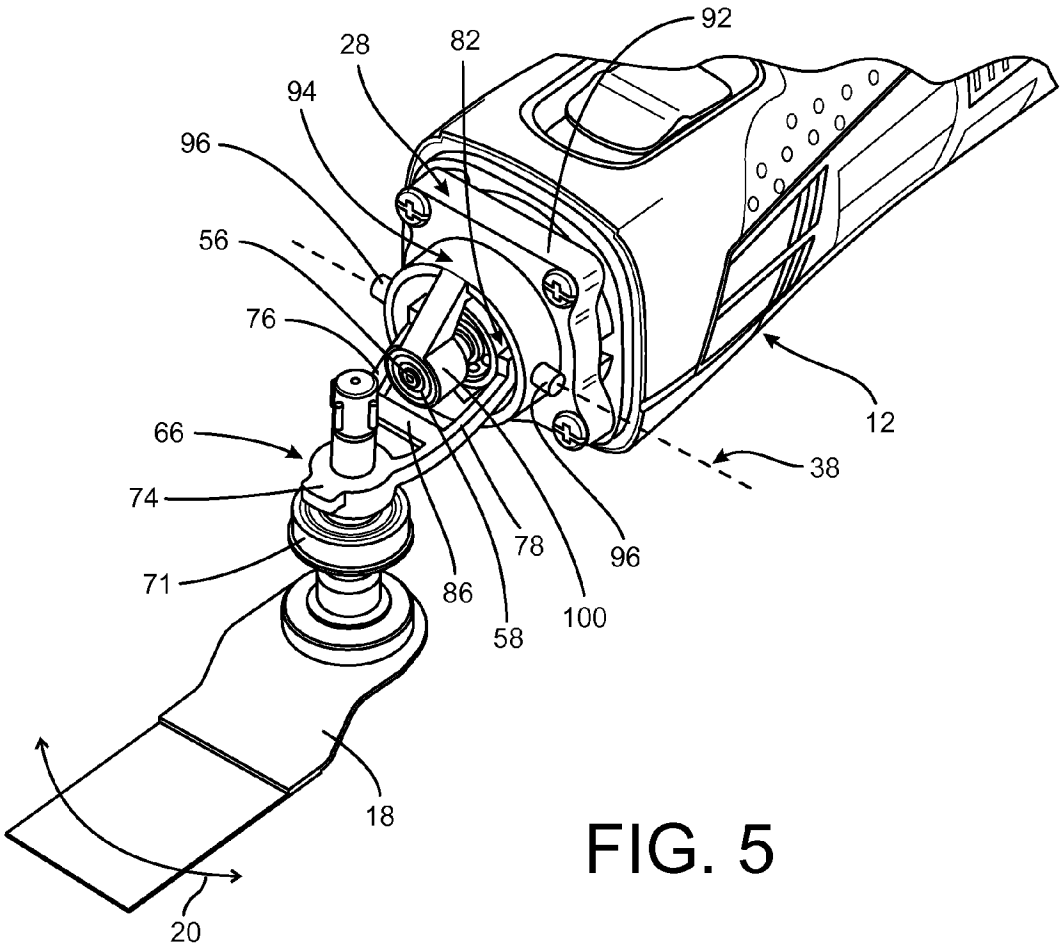
FIG. 5 is a perspective view of the nose portion of the tool of FIG. 1 without the housing for the tool holder.

FIG. 5 is a perspective view of the nose portion of the tool of FIG. 1 without the housing for the tool holder. The drive shaft support 28, which receives the end portion 30 of the drive shaft, includes a base portion 92 operatively coupled to the housing 12. A substantially cylindrical portion 94 coupled to and extending from the base portion 92 provides clearance for the drive bearing 60 and the terminating ends of branches 76 and 78 in contact with the outer ring 64. The substantially cylindrical portion 94 includes a first pivot pin 96 and a second pivot pin 98, each of which are fixed and coupled to an outer surface of the cylinder 94. The pivot pins 96 and 98 provide attachment points for the articulating arms 34 and 36 about which rotation occurs at rotational axis 38. Coupled to and extending from the cylindrical portion 94 is a bearing support 100 which captures the support housing bearing 58 to provide for rotation of the portion 30. Open spaces or apertures on either side of the extended bearing support 100 are provided for the first branch 34 and the second branch 36 to contact the outer ring 64.

FIG. 4 and FIG. 5 additionally illustrate the rotational axis 38 and its location through the pivot points of the arms 34 and 36, through the pivot point of the link 66, and in particular through the contacting surfaces 80 and 82. While FIG. 4 and FIG. 5 show these pivot points being co-linear, other configurations are possible.

Figure 7:
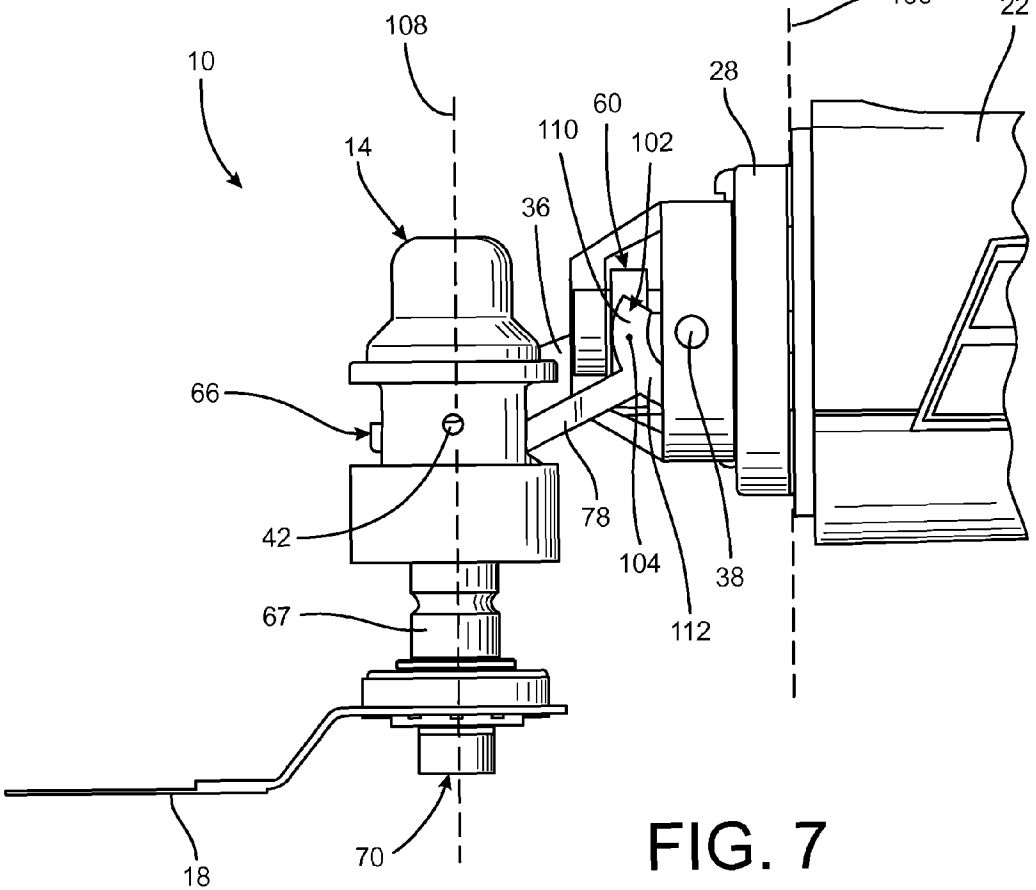
FIG. 7 is a partial elevational side view of another embodiment of an oscillating power tool.
Figure 8:
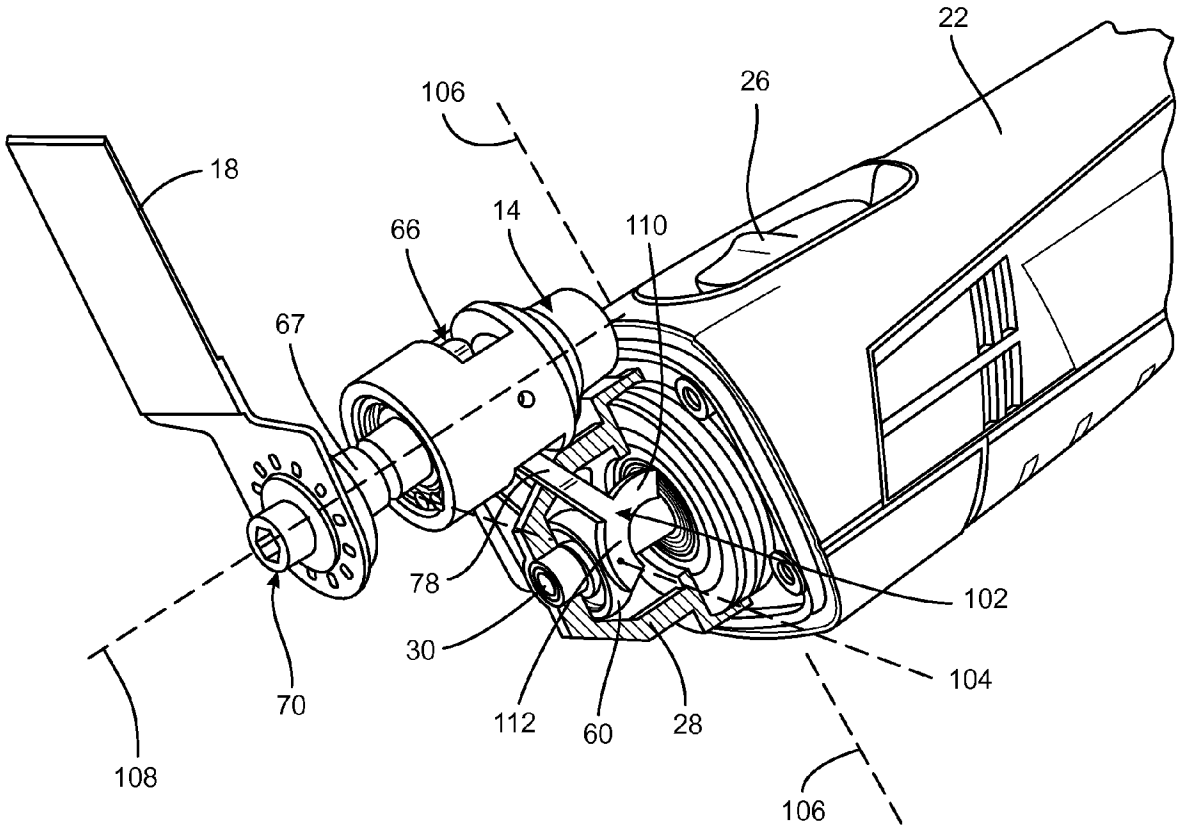
FIG. 8 is a partial perspective view of the nose portion of the tool of FIG. 7 without one of the articulating support arms.

FIGS. 7 and 8 illustrate another embodiment of the power tool 10 in which the bearing 60 is displaced from being aligned with the pivot axis 38 of the articulating arms 32 and 36. In this embodiment, the bearing 60 is placed on the eccentric drive shaft 56 at a location between the housing 14 and the pivot axis 38. Each of the first branch 76 and 78 include arcuate contacting portions, only one of which, arcuate contacting portion 102, is shown. The arcuate contacting portions provide a termination to the branches 76 and 78 and each includes an arcuate contacting surface which interfaces with the outer surface of the outer ring 64.

As illustrated in FIGS. 7 and 8, a line 104 generally indicates a direction of oscillation passing through the eccentric drive bearing 62 which is substantially parallel to the axis 38. The line of oscillation 104, while remaining generally fixed with respect to the drive bearing 62, will pass through different areas of the arcuate contacting portions during articulation of the tool head 14 as well as when the tool head 14 is stationary. For instance, FIG. 7 illustrates a plane 106 of the cylindrically shaped housing 12 being substantially parallel with a plane 108 (both illustrated in FIG. 7 as being vertical) of the tool head 14. In this configuration, an upper portion 110 of the arcuate portion 102 is aligned with the axis 104. Once the tool head 14 is articulated approximately ninety degrees with respect to the housing 12 (where the plane 108 is aligned substantially perpendicular to the plane 106), a lower portion 112 of the arcuate portion 102 is aligned with the axis 104 as illustrated in FIG. 8. During articulation of the tool 18 throughout its range of motion, the contacting point of outer ring 64 contacting the arcuate portions remains substantially fixed but the contacting area on the arcuate portions changes locations depending on the orientation of the tool 18 with respect to the tool housing 14. Consequently, during articulation of the tool 18, the contacting area of the contacting portions moves in an arcuate path. In another embodiment, the bearing 60 could be moved to a location between the axis 38 and the base portion 92.

In still another embodiment, the articulating arms 32 and 36 could be fixed at the location of the previously described axis of rotation 38, and a different axis of rotation for articulation of the tool head 14 could be located between the former axis of rotation 38 and the tool head 14 at an articulable joint located along the length of the articulating arms. Articulation could also occur at the interface between the link 66 and the tool mount 67, where the link 66 could include an articulable joint located at a predetermined point along the length of the links 76 and 78 to permit adjustment of the tool head 14. In another embodiment, articulation could occur at the tool mount shaft 67, with an articulator having the articulation occur at the tool mount shaft 67 where the shaft includes an articulable joint. In this configuration, the articulating arms 32 and 36 are fixed at the shaft 67 and are also fixed at the axis 38. Other embodiments can include articulable joints at other locations.

In another alternative embodiment, the eccentric drive shaft 56 could be made to include a fixed eccentric formed as part of the drive shaft 56 such that a bearing including an outer ring rotating about an inner ring is not required. In this embodiment, the contacting surfaces 80 and 82 could be formed of a low friction material. In addition, the terminating ends of each branch could include cylinder bearings rotatably coupled to the terminating ends such that the contacting surfaces 80 and 82 are provided by the bearings. It is within the scope of the present disclosure to make the drive shaft 52 and the eccentric drive shaft 56 as a single part.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An articulating power tool comprising:

a housing;

a motor located in the housing, the motor including a drive shaft configured for rotation about a first pivot axis;

an actuator operatively coupled to the drive shaft configured to convert the rotation of the drive shaft to a side to side oscillation;

a tool holder coupled to the actuator and configured to move in response to movement of the actuator; and an articulator operatively coupled to the housing at a second pivot axis substantially perpendicular to the first pivot axis and about which the articulator rotates, the articulator being operatively coupled to the tool holder at a third pivot axis substantially parallel to the second pivot axis and about which the tool holder is configured to rotate, the articulator configured to adjust the tool holder through a range of positions.

2. The power tool of claim 1 wherein the articulator comprises an articulating support arm, wherein the articulating support arm is operatively coupled to the housing at the second pivot axis and the tool holder is operatively coupled to the articulating support arm at the third pivot axis.

3. The power tool of claim 1 wherein the articulator comprises an articulating support arm, the articulating support arm including a length and an articulable joint is located along the length thereof.

4. The power tool of claim 1 wherein the articulator comprises an articulable joint located at the tool holder.

5. The power tool of claim 4, wherein the articulable joint located at the tool holder is located on a tool mount shaft.

6. The power tool of claim 2 wherein the actuator includes an eccentric having a contact surface and a link having a first end to contact the contact surface of the eccentric and a second end coupled to the tool holder.

7. The power tool of claim 6 wherein the eccentric includes a drive ring eccentrically mounted to the drive shaft, the drive ring including the contact surface.

8. The power tool of claim 7 wherein the first end includes a terminating portion disposed adjacently to the contact surface of the drive ring.

9. The power tool of claim 8 wherein the terminating portion contacts the contact surface of the drive ring intermittently and in a direction of the side to side oscillation which is generally perpendicular to the first pivot axis.

10. The power tool of claim 9 wherein the second pivot axis is substantially parallel with the direction of the side to side oscillation of the terminating portion.

11. The power tool of claim 9 wherein the second pivot axis is substantially co-linear with the direction of oscillation of the terminating portion.

12. The power tool of claim 6 wherein the tool holder comprises a shaft rotationally mounted within a housing, the shaft including a receiving portion adapted to receive a tool and a mount to hold the second end of the link in fixed relation to the shaft.

13. The power tool of claim 7 wherein the drive ring comprises a drive bearing having an inner ring, and an outer ring including the contact surface, wherein the inner ring rotates within the outer ring.

14. The power tool of claim 13 wherein the link comprises a fork having a first branch and a second branch, at least one of the first branch and the second branch having terminating portions in intermittent contact with the contact surface of the outer ring, and a central portion coupled to the first branch and the second branch, the central portion being coupled to the tool holder.

15. The power tool of claim 1 wherein the actuator includes an eccentric and a link having an arcuate contacting portion configured to contact the eccentric wherein pivoting of the articulator about the second pivot axis changes the location at which the eccentric contacts the arcuate contacting portion.

16. The power tool of claim 15 wherein the arcuate contacting portion includes a central portion and two end portions wherein the two end portions extend further away from the tool holder than the central portion when the central portion is in contact with the eccentric.

17. An articulating power tool comprising:

a housing;

a motor including a drive shaft having an eccentric configured to rotate about a first axis;

a fork having a first branch having a first end, a second branch having a second end, and a central portion coupled to the first branch and the second branch, wherein at least one of the first end and second end intermittently contact the eccentric to move the first end, the second end and the central portion in a side to side oscillation;

a tool holder coupled to the central portion of the fork and configured to move in response to the movement of the central portion; and an articulating arm operatively coupled to the housing and to the tool holder, the articulating arm configured to move the tool holder through a range of positions, wherein the articulating arm pivots about a second axis substantially perpendicular to the first axis and the tool holder pivots about a third axis defined on the articulating arm, the third axis being substantially parallel to the second axis.

18. The power tool of claim 17 wherein the fork oscillates in a direction generally parallel to the second axis and passing through a contact surface of the eccentric.

19. The power tool of claim 18 wherein the second axis and the direction of the side to side oscillation of the first and second end are substantially co-linear.

20. The power tool of claim 18 wherein the eccentric includes a drive bearing having an inner ring, and an outer ring including the contact surface, wherein the inner ring rotates within the outer ring.

21. The power tool of claim 20 wherein the articulating arm pivots about the second axis through a range of about zero to ninety degrees to adjust the position of the tool head with respect to the housing.

22. The power tool of claim 17 wherein the first end and the second end each terminate in an arcuate contacting portion each of which are configured to contact the eccentric, wherein pivoting of the articulating arm about the second axis changes the location at which the eccentric contacts each of the arcuate contacting portions.

23. The power tool of claim 22 wherein each of the arcuate contacting portions includes a central portion and two end portions wherein the two end portions extend further away from the tool holder than the central portion when the central portion is in contact with the eccentric.

* * * * *